US007237536B2

(12) United States Patent
Schmitfranz et al.

(10) Patent No.: US 7,237,536 B2
(45) Date of Patent: Jul. 3, 2007

(54) METHOD FOR ASCERTAINING THE POSITION OF A MOBILE CLOSING ELEMENT OF AN INJECTION VALVE

(75) Inventors: Bernd-Heinrich Schmitfranz, Esslingen (DE); Guenter Stoehr, Neuhausen (DE)

(73) Assignee: DaimlerChrysler AG, Stuttgart (DE)

( * ) Notice: Subject to any disclaimer, the term of this patent is extended or adjusted under 35 U.S.C. 154(b) by 315 days.

(21) Appl. No.: 11/089,169

(22) Filed: Mar. 25, 2005

(65) Prior Publication Data

US 2005/0224050 A1 Oct. 13, 2005

(30) Foreign Application Priority Data

Mar. 26, 2004 (DE) ..... 10 2004 015 045

(51) Int. Cl.
*F02M 37/04* (2006.01)

(52) U.S. Cl. ..... 123/498; 123/494

(58) Field of Classification Search ..... 123/498, 123/467, 494
See application file for complete search history.

(56) References Cited

U.S. PATENT DOCUMENTS 6,968,829 B2 * 11/2005 Joos et al. ..... 123/490
2006/0255302 A1 * 11/2006 Aspelmayr et al. .... 251/129.06
2007/0001545 A1 * 1/2007 Schoor et al. ..... 310/317

FOREIGN PATENT DOCUMENTS

DE 19930309 C2 12/2001

* cited by examiner

*Primary Examiner*—Thomas Moulis
(74) *Attorney, Agent, or Firm*—Crowell & Moring LLP

(57) ABSTRACT

In a method for ascertaining the position of a mobile closing element of an injector valve in a motor vehicle engine, in which the closing element is driven by a piezoelectric element for opening or closing the injection valve and a voltage signal allocated to an electrical voltage recorded on the piezoelectric element, the position of the closing element is ascertained from the ascertained voltage signal. Through a two-way valve arranged on the injection valve, a change in the voltage signal is brought about based upon a change in the electrical voltage on the piezoelectric element as a function of the position of the closing element.

20 Claims, 3 Drawing Sheets

METHOD FOR ASCERTAINING THE POSITION OF A MOBILE CLOSING ELEMENT OF AN INJECTION VALVE

This application claims the priority of German application 102004015045.1, filed Mar. 26, 2004, the disclosure of which is expressly incorporated by reference herein.

BACKGROUND AND SUMMARY OF THE INVENTION

This invention concerns a method for ascertaining the position of a mobile closing element of an injection valve in a motor vehicle engine.

Storage injection systems are used for supplying fuel for internal combustion motors which operate at very high injection pressures. Such injection systems are known, for example, as common rail systems. These injection systems are distinguished in that the fuel is conveyed with a high pressure pump into a pressure storage unit jointly allocated to all cylinders of the motor, from which the injection valves on the individual cylinders are supplied. The injection valves are frequently also called injectors. The opening and closing of the injection valves are usually electrically controlled, for example with the aid of piezoelectric elements as actuators.

A control valve can be connected between the nozzle element, with the nozzle needle which opens and closes the injection apertures in the injection valve, and the piezoelectric actuator, as a closing element in injection valves or injectors. The control valve serves to bring about the opening and closing of the actual fuel injection valve hydraulically. That in particular means establishing the beginning and the end of the injection process exactly in time. The injection valve should, for example, open and, at the end of the injection process, rapidly close in a controlled manner. The injection of minute amounts of fuel for preliminary injection before the actual injection, with which the combustion process can be optimized, should also be possible. The closing element can nonetheless also be arranged in another form and at another place on the injection valve, for example as a valve hinged cover or needle valve at the valve exit. An injector needle can be used as a closing element. The injection valve can be constructed as a needle valve.

A method for regulating a fuel injection process with a fuel injection valve for a motor vehicle internal combustion engine is known from German Patent 199 30 309 C2. A control valve as closing element is activated by a piezoelectric element as an actuator for opening the injection valve. The piezoelectric element is electrically actuated to change the state of the closing element. Following this actuation, the voltage on the piezoelectric element is measured and the beginning of injection or the needle opening of the injection valve is ascertained on the basis of the voltage measured.

An object of the invention is to make it possible to simply, exactly, and rapidly ascertain the position of a closing element of an injection valve in a motor vehicle engine.

This object is accomplished, in a method in which a closing element is driven using a piezoelectric element for opening or closing an injection valve, by determining a voltage signal allocated to an electric voltage on the piezoelectric element, and determining the position of the closing element from the voltage signal ascertained as a change of the voltage signal, based upon a change in the electric voltage on the piezoelectric element, is brought about by a two-way valve arranged on the injection valve as a function of the position of the closing element.

Preferably, the method for ascertaining the position of a closing element in connection with a fuel injection valve is conducted with a motor vehicle internal combustion engine. The closing element is driven using a piezoelectric element to open and close the injection valve. With the closing element, preferably an injector needle is guided one dimensionally in a mounting in the longitudinal direction of the needle. Nonetheless, the method is not restricted to the special case of an injector needle, and can also be conducted with other closing elements such as, for example, controllable hinged covers or ball valves.

The piezoelectric element is electrically actuated by means of a control apparatus for opening and closing the injection valve. An electric voltage is recorded on the piezoelectric element, and an output signal is allocated to the electrical voltage recorded. The position of the closing element is ascertained from a voltage signal representing the voltage incident upon the piezoelectric element. Ascertaining the position of the closing element can take place simply and exactly, since a change of the electric voltage recorded on the piezoelectric element, and consequently a change in the voltage signal, is brought about using a two-way valve arranged on the injection valve as a function of the position of the closing element.

A further advantage is that an additional sensor element and an evaluation of additional sensor signals can be dispensed with.

According to one feature of the invention, the alteration of the electrical voltage is brought about on the piezoelectric element using a change in pressure in liquid surrounding the piezoelectric element, caused by an opening or closing of the two-way valve. As an alternative to this, the pressure change can take place in a liquid standing in contact with a transmission medium, whereby the transmission medium stands in mechanical contact with the piezoelectric element.

It is especially advantageous if the pressure change takes place abruptly during opening or closing of the two-way valve. When the pressure in the liquid surrounding the piezoelectric element changes very rapidly, the voltage signal allocated to the voltage on the piezoelectric element has a pulse-like course, that is, the voltage signal changes rapidly at points in time allocated to the pressure change. Thus, it has a great "elevation" or slope. A voltage signal with a pulse-like course makes an especially exact and reliable determination of the position of the closing element possible.

It is especially advantageous if the temporal derivation of the voltage signal is adduced for ascertaining the position of the closing element. Moreover, it is possible to ascertain the position of the closing element rapidly and exactly in a pulse-like course of the voltage signal.

In one embodiment, a first portion of the batch of fuel from the injection valve, standing under pressure and to be injected into a useful space, is guided through a surrounding space formed around the piezoelectric element. A second part of the batch of fuel to be injected is led into a bypass line.

According to a further feature, the piezoelectric element is driven using a current drive for controlling the closing device of the injection valve. The closing device of the injection valve is controlled by specifying the current flowing through the piezoelectric element. The electric voltage in reference to the piezoelectric element is recorded and evaluated for ascertaining the position of the closing element. As an alternative to recording the piezoelectric voltage while administering current, recording the piezoelectric voltage can also take place in pauses in the administration of current.

For this purpose, the piezoelectric element can be electrically separated from the current supply in pauses in administration of current so that recording of the piezoelectric voltage is possible on the electrically free piezoelectric element.

Preferably ascertaining the position of the closing element will be adduced for regulating the course of injection of an injection value. Regulation of the course of injection can take place to reduce fuel consumption, to diminish toxic emissions or, for example, to optimize, and especially reduce, the motor noise.

Any desired closing element, such as a valve, can be used for the closing element of the injection valve but a longitudinally displaceable injector needle is preferably used.

In a further configuration, the two-way valve includes a recess in the injector needle which, in a first position of the injector needle, interacts with a recess in the needle guide such that a liquid can flow from the one recess into the other. In a second position of the injector needle, flowing of a liquid from one recess into the other recess is prevented.

An especially advantageous application of the method arises in measuring the needle position of an injector needle driven using a piezoelectric element in an injector. With regard to their dynamic behavior, piezoelectric actuators make possible high positioning forces and short response times in tightly restricted injector contours, such as preliminary injection and postinjection, to reduce the development of noise and toxic substances during the course of combustion. Here the exact knowledge of the position of the injector needle in relation to the camshaft adjustment is especially advantageous for injection periods smaller than 100 μs.

A force F(t) acting upon the piezoelectric element, preferably in an axial direction, is transformed into piezoelectric voltage. This possesses the advantage that an additional installation of a piezoelectric element as a sensor can be dispensed with.

With the aid of the equations $$\Delta 1 = s_{33}^{E} \cdot 1/A \cdot F + d_{33} \cdot n \cdot u_p \tag{1}$$

$$i_p = d_{33} \cdot n \cdot dF/dt + \epsilon_{33}^{T} \cdot n^2 \cdot A/1 \cdot du_p/dt \tag{2}$$

in which Δ1 is a change in length of the piezoelectric element, $D_n$ is an electric displacement flux density on the piezoelectric element, 1 the total length of the piezoelement, $E_m$ the electrical field strength on the piezoelectric element, A the surface of the piezoelectric element, $S_i$ the mechanical extension, F the external force on surface A and $T_j$ the voltage tensor, up the piezoelectric voltage, $q_p = \int i_p \, dt$ the electric charge, $d_{in}$ the piezoelectric coefficient, $i_p$ the piezoelectric current, and $C_E = \epsilon_{33}^{T} \cdot n^2 \cdot A/1$ the replacement capacitance of the piezoelectric element.

Furthermore the following applies for the dielectric constants:

$$\epsilon_{mm}^{T} = \partial D_n / \partial E_m |_T$$

with the number of ceramic layers n and for the elasticity coefficient:

$$s_{ij}^{E} = \partial S_i / \partial T_j |_E.$$

The description of the connections between the change in length Δ1 of the piezoelectric stack, the force F upon the piezoelectric stack, the piezoelectric current $i_p$ and the piezoelectric voltage up takes place through elimination of the change in force over time dF/dt, to detect the influence of the needle motion in the direction of its speed of motion dΔ1/dt on the temporal change of the piezoelectric voltage $du_P/dt$.

$$du_P/dt = i_P \cdot 1/A \cdot 1/(\epsilon_{33}^{T} \cdot n^2) - dF/dt \cdot 1/A \cdot d_{33}/(\epsilon_{33}^{T} \cdot n) \tag{3}$$

$$dF/dt = d\Delta 1/dt \cdot A/(1 \cdot s_{33}^{E}) - du_p/dt \cdot A \cdot d_{33} \cdot n/(1 \cdot s_{33}^{E}) \tag{4}$$

The equation is solved according to dup/dt. The leading magnitudes are then $i_P$ and dΔ1/dt. The equation for the temporal change of the piezoelectric voltage $du_P/dt$ as a function of piezoelectric current $i_P$ and the change in length per unit of time dΔ1/dt then reads:

$$du_P/dt = \{i_P \cdot 1/(A \cdot n) - d\Delta 1/dt \cdot d_{33}/s_{33}^{E}\} \cdot \{1/n \cdot s_{33}^{E}/(s_{33}^{E} \cdot \epsilon_{33}^{T} - (d_{33})^2)\} \tag{5}$$

By ascertaining the change in voltage on the piezoelectric element when evaluating this equation, an especially efficient ascertaining of the needle position of the injection valve is possible. For this, a specifiable disturbance is introduced into an existing piezoelectric injector system such that the originally unimpeded flow of fuel, proceeding from the common rail to the motor cylinder, assumes a pulse-like course through the two-way valve. This pressure pulse resulting as a consequence of force pulses in the liquid surrounding the piezoelectric injector acts as a change in the ambient pressure upon the piezoelectric element and is imaged in the voltage signal u(t) in the electric feeder lines of the piezoelectric element as a measured magnitude. A temporal derivation of the piezoelectric voltage makes possible a good localization of the state of the needle, especially for the beginning and end of an injection. The measuring signal stands out clearly in relation to interference signals, and an especially high resolution of the position is attainable.

DETAILED DESCRIPTION OF THE INVENTION

Figure 1:
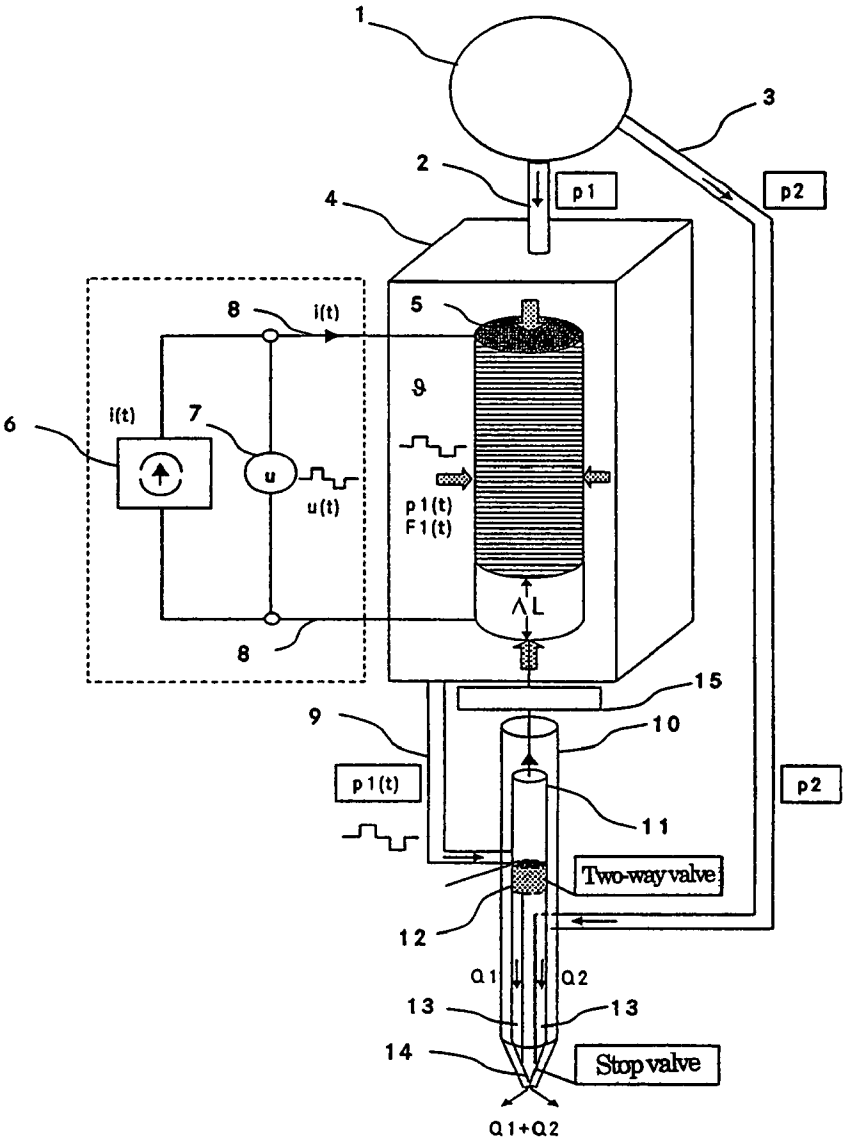
FIG. 1 shows an example of an injection valve with an evaluation circuit for ascertaining the position of the closing element of the injection valve.

FIG. 1 illustrates an injection valve with an evaluation circuit for ascertaining the position of the closing element of the injection valve, which is suited for generating pressure pulses p1(t). A fuel pressure p predetermined by the common rail 1 is separated in two feeder lines 2 and 3 into two partial pressures p1 and p2. Here feeder line 3 forms a bypass line. Fuel flowing through feeder line 2 forms a volume 4, which surrounds the piezoelectric stack 5 formed from several individual piezoelectric elements and maintains the ambient temperature θ at a permissible value during the injection for protection of the piezoelectric actuator. The piezoelectric stack 5 consisting of several individual piezoelectric elements once again forms a piezoelectric element acting as a piezoelectric actuator. The fuel pressure in feeder line 9 extends into the high pressure chamber 10 and to the two-way valve 12, that is open or closed as a function of the position of the injector needle ΔL. The opening and closing of the two-way valve brings about rapid pressure changes in the form of pressure pulses p1(t) in the surroundings of the piezoelectric element. Through channel 13 on the injector needle 11, the fuel batch Q1 extends to the stop valve 14, that regulates the amount of fuel through its nozzle aperture.

The fuel pressure of the fuel batch Q2 in the bypass line 3 extends directly into the high pressure chamber 10, to channels 13 and the stop valve 14. The shape of the injector needle and the needle surroundings can be configured such that the pressure acting upon the surface of the injector needle tip brings about a hydraulic support for opening the injector needle. Opening the injector needle could nonetheless also take place exclusively through the piezoelectric actuator or exclusively through the hydraulic action of the liquid to be injected onto the injector needle.

A piezoelectric current i(t) flows through the piezoelectric stack 5 from a controlled current source 6 through the electric feeder lines 8 in the closed initial state of the injector needle 11 or the stop valve 14, which brings about a lasting elongation of the piezoelectric stack 5 around the length change ΔL in the case of direct current. This maximal length presses the tip of the injector needle 11, for example through a hydraulic, mechanical or hydraulic-mechanical coupling 15, into the seat of the nozzle and closes the stop valve 14 as well as the two-way valve 12.

In order to attain the opened state of the injector needle 11, the current source 6 controls the current i(t) to the value zero or in the opposite direction, which brings about a shortening of the piezoelectric stack by ΔL. This minimal length draws the injector needle 11 out of its seat through the coupling 15, which is still supported by the fuel pressure p2 in line 3, and opens the two-way valve 12. Moreover, the pressure p1(t) is abruptly diminished in feeder line 9 and especially in volume 4, owing to which the accompanying diminution of force on the cover surfaces of the piezoelectric stack calls forth an abrupt change in the temporal course of the piezoelectric voltage u(t) on the voltage measurement device 7. This voltage pulse stands in direct connection with the opened needle position and permits identifying the point in time for a beginning of injection.

The closed state of the injector needle 11 is once again attained by the administration of current to the piezoelectric stack 5 from the same current source 6. This brings about a lengthening of the piezoelectric stack by the segment ΔL, presses the injector needle 11 back into its seat over the coupling 15 and closes the stop valve 14. The two-way valve 12 at the same time closes and abruptly raises the pressure p1(t) in volume 4, owing to which the retroactive increase in force on the cover surfaces of the piezoelectric stack calls forth an abrupt change in the temporal course of the piezoelectric voltage u(t) on the measuring device 7, but with the opposite sign in comparison with the needle opening. This voltage pulse then stands in a direct connection with the closed needle position and permits determining the point in time of the end of injection.

Figure 2:
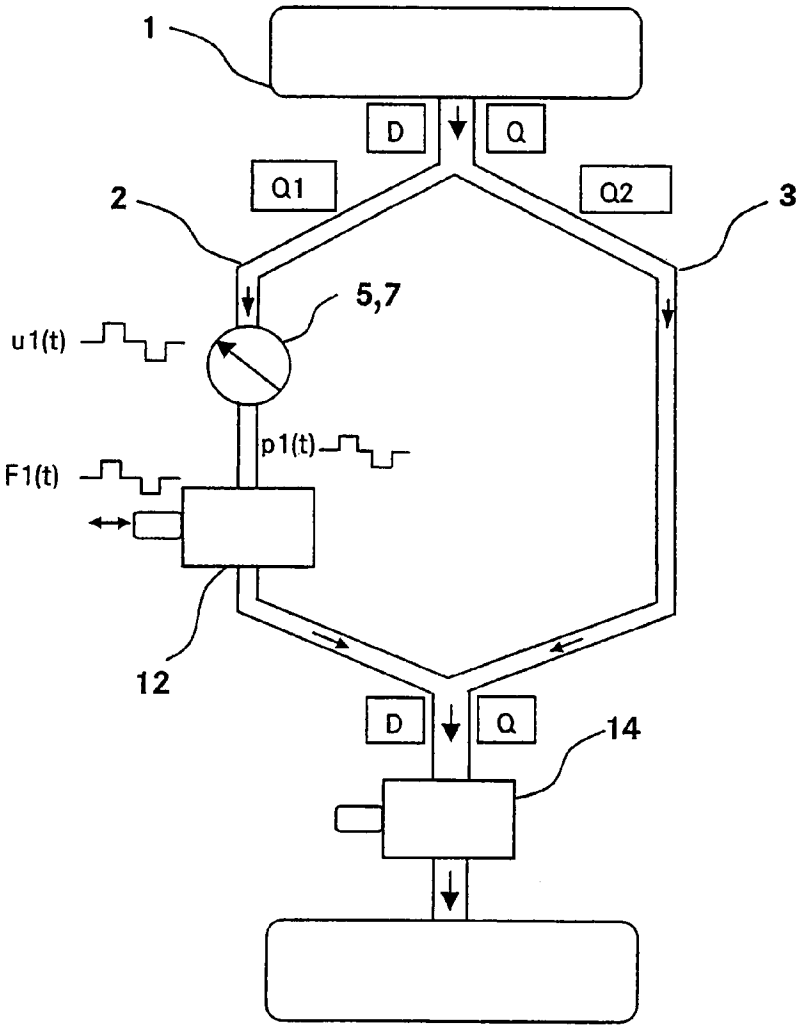
FIG. 2 is a schematic representation of a device for implementing the method for ascertaining the position of a closing element of an injection valve with a bypass line.

FIG. 2 is a schematic representation of a device for implementing the method for ascertaining the position of a closing element of an injection valve with a bypass line. The principle of converting force pulses F1(t) caused by the two-way valve 12 into pressure pulses p1(t) within a line 2 subjected to fuel flow through is clarified with the help of FIG. 2. These pressure changes act upon a piezoelectric stack 5 acting as a manometer, which transforms these pressure changes into equivalent electric voltage pulses u(t) on the device 7. A mechanical-hydraulic-electrically coupled system for recording mechanical motion sequence in common rail injectors is therewith made available.

The fuel pressure maintained constant p=const. extends into a bifurcated line system through the injector intake with diameter D and flow through amount Q, of which line 2 guides fuel batch Q1 through the "manometer" 5 as well as through the two-way valve 12, and bypass line 3 guides fuel batch Q2 directly through the mechanically-activated stop valve 14 into the motor cylinder.

Figure 3:
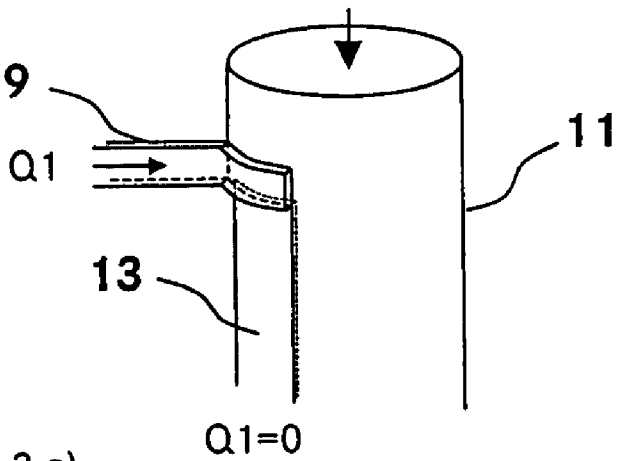
FIGS. 3*a* and 3*b* show a two-way valve in the closed and opened states.
Figure 3:
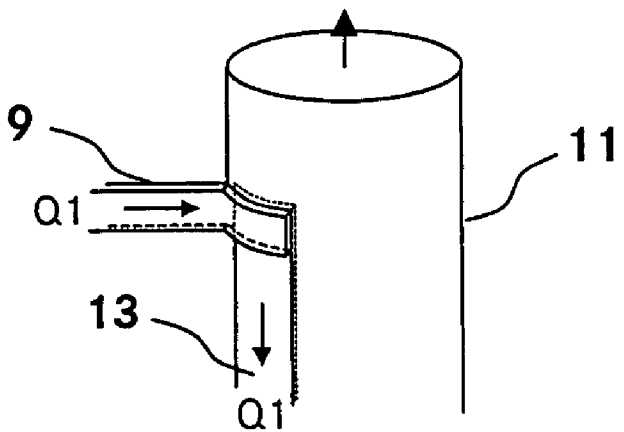

FIGS. 3*a* and 3*b* illustrate a two-way valve in the opened and closed states. In the position shown in FIG. 3*a,* the two-way valve is closed and in the position shown in FIG. 3*b,* the two-way valve is opened. The stationary feeder line 9 leads the through flow amount Q1 of fuel to the surface of the mobile injector needle 11. In the closed state, the introduction of fuel on channel 13 is blocked and a through flow Q1 to the stop valve 14 is prevented. In the open state, the end of feeder line 9 covers channel 13 and releases the flow through amount Q1 to the stop valve. The desired pressure pulses p1(t) arise during the change in state for identification of the injection duration of piezoelectric injectors.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. A method for ascertaining a position of a mobile closing element of an injection valve in a motor vehicle engine, in which the closing element is driven using a piezoelectric element for opening or closing the injection valve, comprising:

determining a voltage signal allocated to an electric voltage on the piezoelectric element, and determining the position of the closing element from the voltage signal ascertained as a change of the voltage signal, based upon a change in the electric voltage on the piezoelectric element which is brought about by a two-way valve arranged on the injection valve as a function of the position of the closing element.

2. The method according to claim 1, wherein the change in the electric voltage on the piezoelectric element is brought about by a pressure change in a liquid surrounding the piezoelectric element caused by opening or closing the two-way valve.

3. The method according to claim 2, wherein the pressure change takes place abruptly upon opening or closing the two-way valve so that the voltage signal allocated to the electric voltage on the piezoelectric element has a pulse-like course.

4. The method according to claim 1, wherein a temporal derivation of the voltage signal is adduced to ascertain the position of the closing element.

5. The method according to claim 1, wherein a first portion of a fuel batch standing under pressure to be injected by the injection valve into a useful space is passed through a surrounding space formed about the piezoelectric element, and a second portion of the fuel batch to be injected is passed in a bypass line.

6. The method according to claim 1, wherein the piezoelectric element, for controlling the closing device of the injection valve, is driven by a current control unit.

7. The method according to claim 1, wherein the position of the closing element is determined for regulating a course of injection.

8. The method according to claim 1, wherein the closing element is a longitudinally displaceable injector needle.

9. The method according to claim 8, wherein the two-way valve includes a recess in at least one of the injector needle and a needle guide for the injector needle so that, in a first position of the injector needle, liquid can flow through the recess and, in a second position of the injector needle, flow of the liquid through the at least one recess is prevented.

10. The method according to claim 2, wherein a temporal derivation of the voltage signal is adduced to ascertain the position of the closing element.

11. The method according to claim 3, wherein a temporal derivation of the voltage signal is adduced to ascertain the position of the closing element.

12. The method according to claim 2, wherein a first portion of a fuel batch standing under pressure to be injected by the injection valve into a useful space is passed through a surrounding space formed about the piezoelectric element, and a second portion of the fuel batch to be injected is passed in a bypass line.

13. The method according to claim 3, wherein a first portion of a fuel batch standing under pressure to be injected by the injection valve into a useful space is passed through a surrounding space formed about the piezoelectric element, and a second portion of the fuel batch to be injected is passed in a bypass line.

14. The method according to claim 4, wherein a first portion of a fuel batch standing under pressure to be injected by the injection valve into a useful space is passed through a surrounding space formed about the piezoelectric element, and a second portion of the fuel batch to be injected is passed in a bypass line.

15. The method according to claim 2, wherein the piezoelectric element, for controlling the closing device of the injection valve, is driven by a current control unit.

16. The method according to claim 3, wherein the piezoelectric element, for controlling the closing device of the injection valve, is driven by a current control unit.

17. The method according to claim 4, wherein the piezoelectric element, for controlling the closing device of the injection valve, is driven by a current control unit.

18. The method according to claim 5, wherein the piezoelectric element, for controlling the closing device of the injection valve, is driven by a current control unit.

19. The method according to claim 2, wherein the position of the closing element is determined for regulating a course of injection.

20. An injection valve and an evaluation circuit for performing the method of claim 1.

* * * * *